US010428510B1

(12) United States Patent
Moore, Jr. et al.

(10) Patent No.: US 10,428,510 B1
(45) **Date of Patent: *Oct. 1, 2019**

(54) LEACHING UNIT HAVING OVERHANGING AND PERFORATED CANOPY

(71) Applicant: Infiltrator Water Technologies LLC, Old Saybrook, CT (US)

(72) Inventors: Roy E. Moore, Jr., Killingworth, CT (US); Paul R. Holbrook, Old Saybrook, CT (US)

(73) Assignee: INFILTRATOR WATER TECHNOLOGIES LLC, Old Saybrook, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/484,880

(22) Filed: Apr. 11, 2017

Related U.S. Application Data

(63) Continuation of application No. 14/635,597, filed on Mar. 2, 2015, now Pat. No. 9,670,660.

(51) Int. Cl.
*E03F 1/00* (2006.01)
*E03F 3/04* (2006.01)

(52) U.S. Cl.
CPC ..... *E03F 1/003* (2013.01); *E03F 1/00* (2013.01); *E03F 3/043* (2013.01)

(58) Field of Classification Search
CPC combination set(s) only.
See application file for complete search history.

(56) References Cited

U.S. PATENT DOCUMENTS 4,896,993 A * 1/1990 Bohnhoff ..... E01C 5/20 404/33
4,925,342 A * 5/1990 Hendy ..... E02B 11/00 405/36
5,848,856 A * 12/1998 Bohnhoff ..... E02B 11/00 405/36
9,670,660 B1 * 6/2017 Moore, Jr. ..... E03F 1/003
2008/0095580 A1 * 4/2008 Blackwood ..... E01C 13/02 405/45
2011/0108559 A1 * 5/2011 Hewing ..... E02B 11/005 220/694

* cited by examiner

*Primary Examiner* — Kyle Armstrong
(74) *Attorney, Agent, or Firm* — C. Nessler

(57) ABSTRACT

A plastic leaching unit for receiving water when buried in trenches in soil comprises a plurality of pillars interconnected by struts. A canopy made of sheet material is attached to the tops of the pillars. The pillars are arranged as spaced apart integral assemblies to enable lateral and vertical bending of the leaching unit, for conforming to a not-straight trench. Preferably, the canopy comprises a second perforated sheet overlying a first sheet having larger perforations, the combination arranged for flow of water and gases while hindering soil particulates. Preferably, the canopy extends a greater amount from the first end of each unit than from the second end, to facilitate end-to-end mating of the units. Leaching units may be stacked one upon the other within a trench.

19 Claims, 9 Drawing Sheets

LEACHING UNIT HAVING OVERHANGING AND PERFORATED CANOPY

TECHNICAL FIELD

The present invention relates to apparatus and method for receiving and dispersing liquids within soil, particularly to devices for forming leaching fields for receiving wastewater.

BACKGROUND

Different kinds of systems—familiarly called leaching systems—are used to disperse water within the soil of the earth in connection with subsurface sewage disposal systems (wastewater systems). Those systems can also be used in other applications for receiving, holding and dispersing other waters or liquids, such as receiving stormwater, or for drainage applications.

A traditional leaching system comprises a perforated pipe running through crushed stone contained within a shallow trench. Tar paper or salt hay, laid on top of the crushed stone, has been used to stop the overlying soil from migrating downward over time into the interstices of the crushed stone.

Another type of leaching system comprises interconnected galleries, namely pre-formed concrete chambers having perforated sidewalls. Buried galleries are often surrounded with crushed stone.

Another type of leaching system utilizes molded or thermoformed plastic leaching chambers. The chambers are arranged as strings of interconnected units, often in parallel spaced-apart rows. A typical chamber has an arch shape cross section, a solid top, an open bottom, a multiplicity of corrugations, and perforated sidewalls. Leaching chambers are exemplified by products sold under the Infiltrator® brand name. Geotextile may sometimes be laid onto the plastic leaching chambers to stop fine sand from migrating into the chamber interior. Crushed stone may be placed against the sidewalls of buried chambers.

Still another type of system comprises horizontally-laid cylindrical leaching units comprised of plastic foam beads contained within netting. These are exemplified by products sold under the EZflow® brand name. Typically an EZflow drainage unit is tubular shape, about 10 to 12 inches in diameter and 10 feet long; and it may comprise an integral barrier of geotextile which stops migration of soil downwardly into the spaces amongst the beads. See U.S. Pat. No. 8,256,990 for a description of such kind of product which includes barriers; the disclosure of the patent is hereby incorporated by reference. Alternately, the installer of a drainage unit may provide a separate overlying barrier which is placed onto the unit before the trench containing the unit is backfilled.

While the primary function of a leaching system is to disperse water to the surrounding soil, it is important that leaching systems provide within themselves space for storing water, to handle situations where the in-flow is greater than the rate of outflow to the surrounding soil. Thus, the storage volume per unit length is important.

Generally, leaching system units which are made of plastic are attractive because of low weight and associated ease of transport and installation compared to the older stone-and-trench and concrete gallery systems. Shipping costs can often be a significant factor and in that respect the arch shape cross section leaching chambers are attractive because they nest readily The height of the leaching unit is also referred to as the profile of the leaching unit. An aim for many applications is to have a leaching unit profile which as low as possible. Low profile units require a shallower trench. That is desirable when the water table or bedrock is not deep since the bottom of a leaching unit should be a certain distance above such features.

Typically there is a regulatory minimum for the overlying soil thickness, usually 6-12 inches, for sanitary reasons. But having overlying soil also reduces the load of a vehicle or the like which is transmitted to the leaching unit. A leaching unit has to be sufficiently strong to resist the weight of overlying soil and other loads, such as motor vehicles which traverse the soil surface.

Inventors have sought to make low profile leaching system units. For example, see the commonly owned low profile leaching chamber described in Moore, U.S. Pat. No. 7,914,230; Ditullio U.S. Pat. No. 6,129,482 and Potts U.S. Pat. No. 7,465,390. Low profile leaching units inherently have less storage capacity per unit length that normal or high profile units; and having good storage capacity can be a regulatory and engineering requirement, particularly when the rate of percolation of water into the soil is low. Thus, it is an aim for any improved unit to have adequate storage volume per unit length.

The leaching units of the above-mentioned prior art systems vary in their load bearing capacity. Generally, arch shape cross section plastic leaching chambers have obtained the requisite strength from a combination of wall thickness, arch shape cross section, corrugations, and ribs. The strength of a plastic bead-within-netting type unit is a function of the crush strength, or compressibility of the bead array.

The present invention is preferably made of plastic. Generally, in a leaching unit which is made of plastic reducing the weight—and therefore the cost of material and shipping—is important to the maker. Product cost is also important: Purchasers are concerned about the cost of providing, by means of a leaching unit, a desired amount of leaching area and a desired amount of storage volume within the system. It is a general object to reduce cost in these contexts.

SUMMARY

An object of the invention is to provide a leaching unit made of plastic or comparable substitute material, where the leaching unit makes efficient use of plastic material, so that it is lightweight but strong. A further object is provide a leaching unit which has a low profile, but at the same time good leaching area and storage volume per unit length, competitive with or better than prior art units. Another objective is to provide a leaching unit which is capable of being compactly stored and shipped.

In accord with the invention a leaching unit embodiment comprises a plurality of interconnected pillars that support an attached canopy made of sheet material. Preferably, the canopy has a multiplicity of perforations and is overlaid with geotextile that inhibits soil particulate from passing through the perforations. In use, the bases of the vertical pillars support the unit within a trench excavation in soil; and soil overlies the canopy. Leaching units may be stacked one upon the other within a trench.

In embodiments of the invention, a leaching unit has a rectangular shape, and comprises a multiplicity of spaced apart integrally molded pillar assemblies. The pillars are arranged as assemblies within which each pillar is connected to other pillars by struts which are preferably attached at the middle portion of the pillar, optionally at the top, and optionally diagonally running. The pillars are preferably molded plastic foam assemblies and may optionally be hollow. The pillar assemblies are spaced apart with respect to the plane of the canopy and along the length of the trench. That feature enables bending of the leaching unit in the lateral plane of the canopy and vertically to accommodate a trench that curves sideways or undulates up and down.

In embodiments of the invention, a leaching unit canopy extends more in the lengthwise direction at one end of the unit than it does at the opposing end of the unit. Thus, when installed in a trench the "long end" of the canopy of one unit overlies and is attached to the opposing end of a like leaching unit. Preferably, an end cap is connected to the end of a leaching unit which has the lesser amount of canopy overhang, when said leaching unit is comprised of an interconnected string of leaching units.

The present invention includes a method for receiving and dispersing or collecting water and other liquids within soil or other granular medium, which involves using a leaching unit as referred to above, making a substantially flat bottom trench in soil, placing the leaching unit in the soil, running a pipe to the end or top of the leaching unit, backfilling the soil on the unit, and either flowing water to the unit, or flowing water from the unit, according to whether it is being used to leach water, such as wastewater into the soil, or to collect and drain water from the soil.

The foregoing and other objects, features and advantages of the present invention will become more apparent from the following description of preferred embodiments and accompanying drawings.

DESCRIPTION

The preferred embodiments of the present invention are described with respect to use as part of a subsurface wastewater treatment system, in particular a leaching system which buried in soil for receiving, holding, treating, or dispersing wastewater received from a primary treatment source such as a septic tank. Thus, the invention articles are referred to as leaching units and leaching assemblies. However such naming shall not be considered as limiting as to the scope and utility of the invention, since within such scope the invention articles may be used for alternative purposes such as for receiving rain water or storm water; or for collecting and draining liquid from soil. Soil, as the term is used herein, refers to natural earth in its variations, including sand and gravel, as well as other materials of a granular nature like natural earth products. Articles of the present invention are preferably made of plastic materials as described more particularly below.

Figure 1:
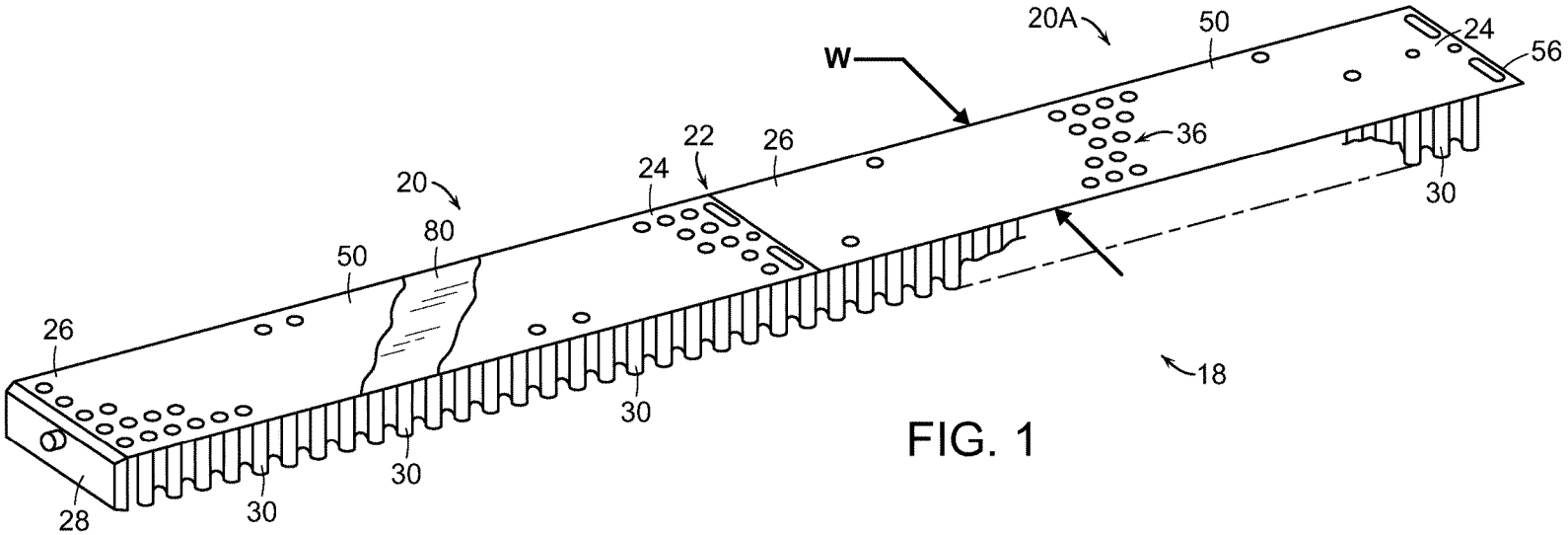
FIG. 1 is a perspective view of two interconnected leaching units.

FIG. 1 is a perspective view of a leaching assembly 18 comprised of two leaching units 20, 20A which are coupled together at joint 22. The leaching units are identical, but are given different numbers to facilitate description below about how they mate. Otherwise, a reference to the features of a leaching unit 20 is a reference to the features of both the units 20, 20A. Each leaching unit 20 is comprised of a plurality of pillars 30 which are spaced apart across the width and length of the unit. The pillars are interconnected by struts. Each unit 20 comprises a canopy 50 having a multiplicity of perforations 36; the canopy is thus water and air permeable. Each leaching unit 20 has a first end 26 and a second end 24. In FIG. 1 an end cap 28 is shown attached to the first end 26 of leaching unit 20. The end cap is described below. The canopy is attached to the tops of the pillars which have essentially flat ends. The attachment of the canopy to the pillar tops helps the canopy as a flexible sheet member carry the load of overlying soil, where the canopy spans the spaces between pillars and pillar assemblies. The canopy is preferably a flat sheet (which may have embossing for strength). The canopy may be said to substantially lie in a plane, within the context that the canopy is made of flexible plastic sheet and will sag between the pillar tops, and the pillars may rest on uneven soil within the trench.

In preferred use, a layer of air or water permeable geotextile fabric 80 lies on top of canopy 50 to inhibit the passage of soil particulates through the perforations of the canopy. A fragment only of geotextile 80 is shown in FIG. 1; and, for simplicity of illustration, geotextile is not shown in most of the other Figures although it is preferably present. Preferably a leaching unit delivered to an installer will have geotextile that has been stapled or otherwise fastened to the top of canopy 50 by the manufacturer. Alternately, an installer may lay a layer of geotextile 80 on a unit 20 at the time of installation within soil. While one layer of fabric will be ordinarily considered sufficient, more than one layer may be used.

It will be understood that in the preferred practice of the invention, the pores or passageways for water and air through the fabric 80 will be smaller in dimension than the perforations of the canopy. In an exemplary leaching unit 20, the perforations 36 may be holes of about one-half inch diameter, as suggested by the illustration of FIG. 2. A preferred fabric for use in the present invention is Product No FX-30HS of Carthage Mills, Cincinnati, Ohio, U.S., a non-woven polypropylene fabric having a permittivity of 2 $sec^{-1}$ and an apparent opening size of 0.2 mm. In alternative embodiments of the invention, a canopy has perforations which are small enough to prevent passage of consequential amounts of soil and numerous enough to provide sufficient water and air permeability for the biological processes attending wastewater treatment in soil and no fabric 80 is used. In still other embodiments of the invention, for instance where migration of air and gases into the interior of the leaching unit may not be not vital, the canopy may be impermeable, and of course, no fabric layer would be needed on the top of the canopy.

Figure 1A:
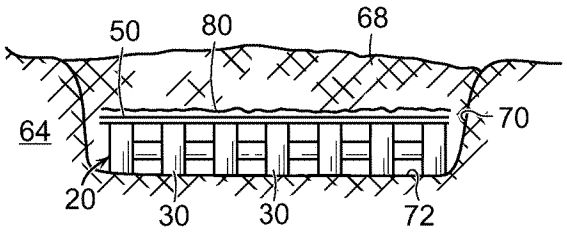
FIG. 1A is a cross section through a trench in soil, containing a leaching unit of FIG. 1, showing the leaching unit in its use configuration.

FIG. 1A portrays a cross section through a leaching unit 20 that has been buried in soil 64 and is ready for use. The unit 20 has been placed on the bottom of an excavation 70 with the bottoms 40 of the pillars 30 resting on the bottom 72 of the excavation. Thus the load of overlying soil on the leaching unit is supported. The bottom ends of the pillars are shaped to provide a desired soil bearing area, and described further below. A geotextile layer 80 lies atop canopy 50 and backfill soil 68 overlies the geotextile. During use of the unit 20, water flows from an end cap location or other entry (not shown), laterally and lengthwise along the length of the leaching unit, within the spaces amongst the pillars. Water and gases can move vertically through the holes in the canopy 50 and the porosity of the geotextile 80, percolating or diffusing through the soil 68 above. Typically there will be an interchange of gas flow between the leaching unit and the atmosphere above the soil surface, as gases resulting from biodegradation flow upwardly, and air flows downwardly.

Figure 19:
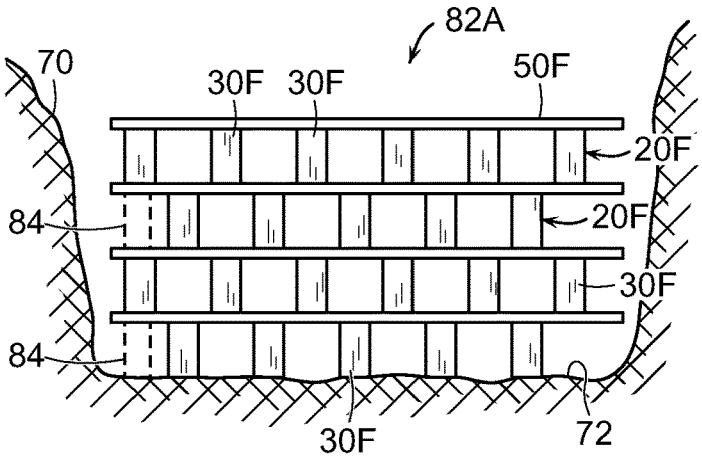
FIG. 19 is an end view of a multiplicity of stacked leaching units comprising a leaching assembly, as it is set within a trench in soil.
Figure 20:
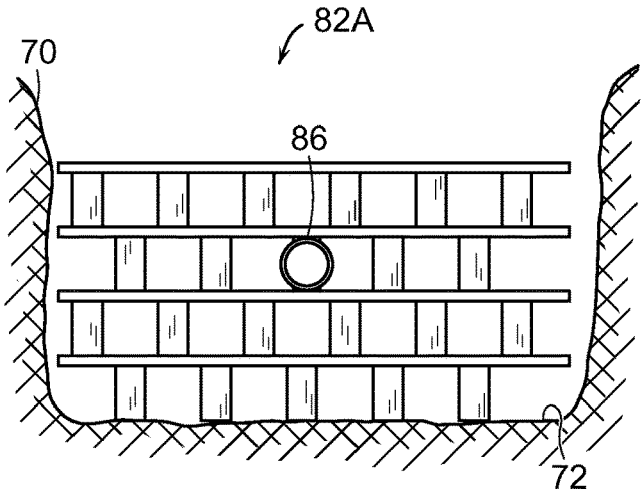
FIG. 20 is a view showing a leaching assembly like that shown in FIG. 19, where the leaching assembly has a central water distribution pipe.

In other installation of leaching units, the permeable fabric that runs on top of the canopy may be draped over the sides of the leaching unit, or over the sides of a stack of leaching units which are described in connection with FIG. 19 and FIG. 20. In still other installations, the fabric may run around the entirely of the leaching unit, in accord with the teachings of U.S. Pat. No. 7,207,747 of A. England, the disclosure of which is hereby incorporated by reference.

Figure 2:
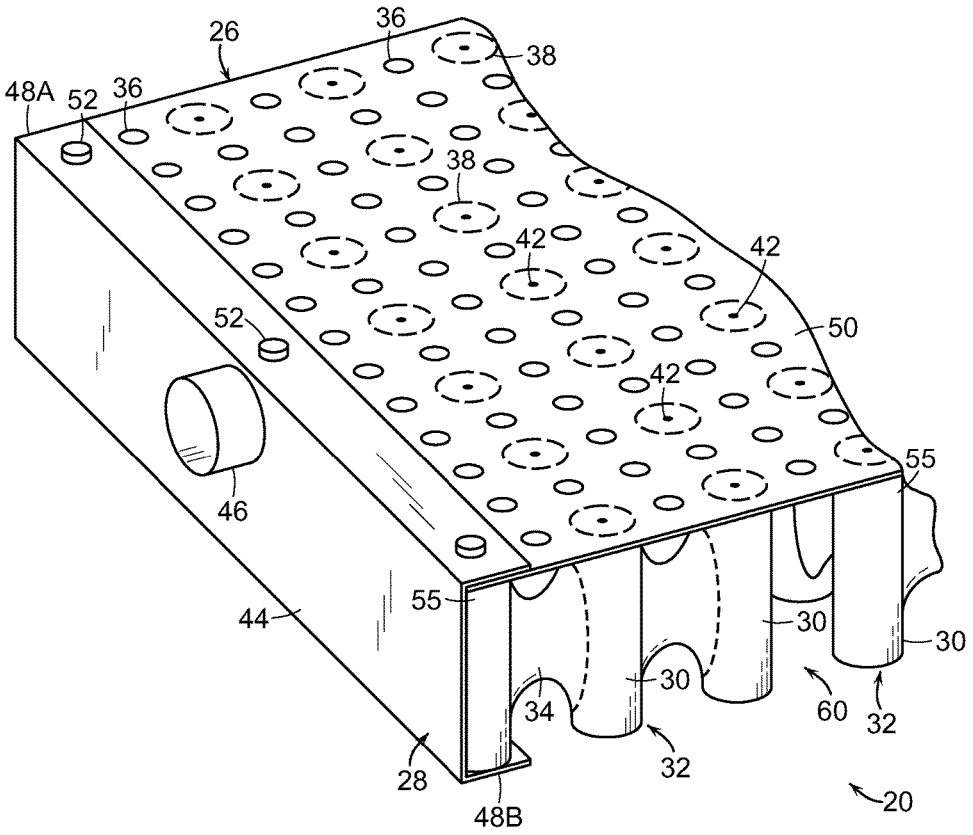
FIG. 2 is a perspective view of an end of one of the leaching units in FIG. 1.
Figure 3:
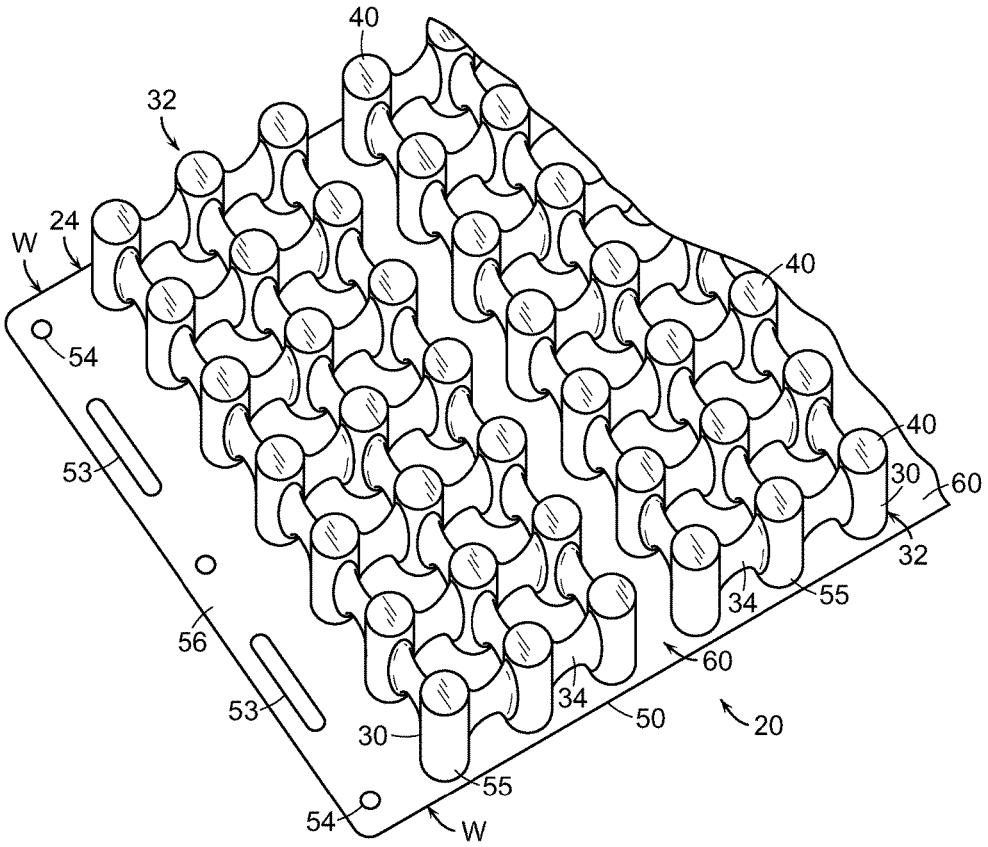
FIG. 3 is a perspective view of the leaching unit shown in FIG. 1, in an inverted orientation.
Figure 6:
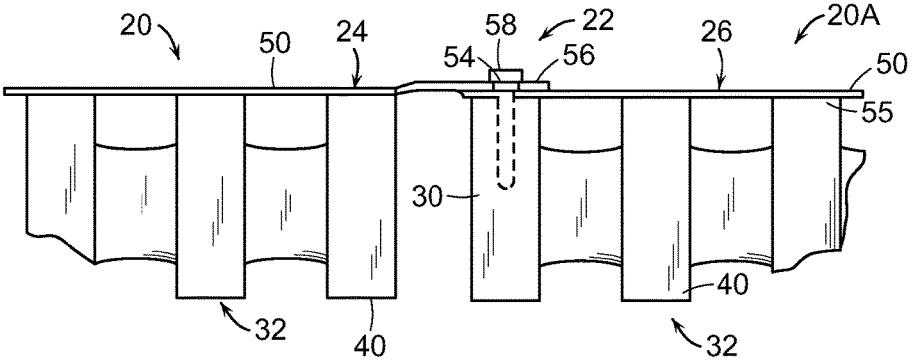
FIG. 6 is a side elevation view of the leaching units shown in FIG. 1 where they mate with each other.

FIG. 2 is a more detailed perspective view of the end 26 of leaching unit 20 showing end cap 28. In FIG. 2 a multiplicity of dashed outlines 38 on canopy 50 show projections of the tops of each pillar 30, as an aid to the viewer here. FIG. 3 is a perspective view of the end 24 of the underside of a typical leaching unit 20; that is, the Figure shows unit 20 in an orientation which is inverted from its use orientation. FIG. 6 is a more detailed side elevation view of the joint between two leaching units.

Figure 4:
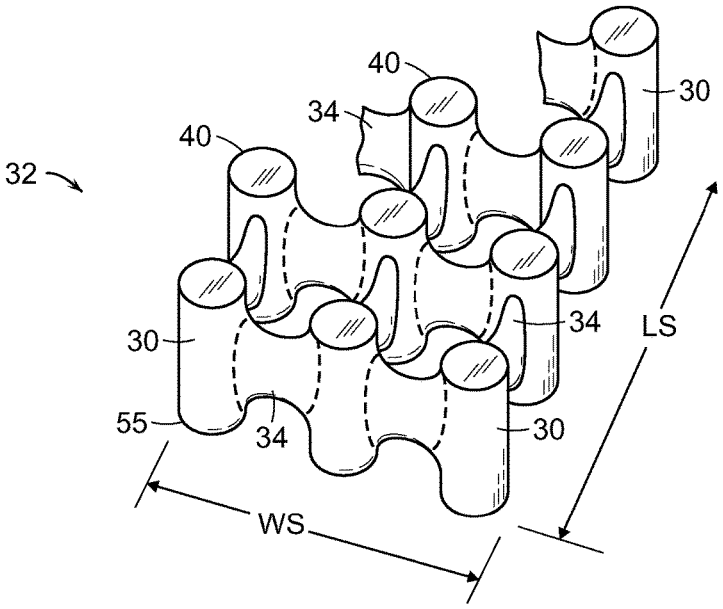
FIG. 4 is a perspective view of a pillar assembly used in the leaching unit of FIG. 1.
Figure 5:
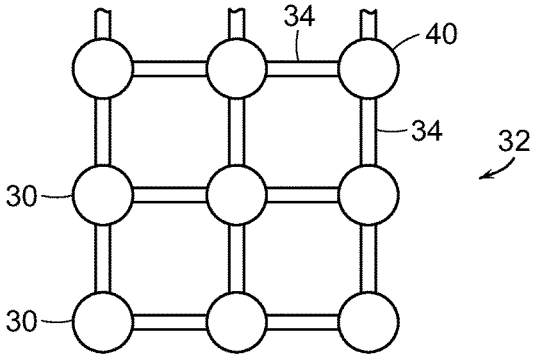
FIG. 5 is a top view of the pillar assembly shown in FIG. 4.

Referring especially to FIGS. 1 to 3, pillars 30 are interconnected with each other by struts 34 or analogous structures to form pillar assemblies 32. Each pillar 30 is connected to two or more other adjacent pillars by struts 34. There are spaces 60 between adjacent pillar assemblies 32 of a leaching unit 20, preferably so that the pillars of adjacent assemblies 32 are nominally at the same spacing as pillars within an assembly 32. The spaces 60 have a function which facilitates bending of a leaching unit in the plane of canopy 50, as described below FIG. 4 is another perspective view of a preferred pillar assembly 32 which has a width WS and a length LS. The pillar assembly length LS runs across the width W of the leaching unit, and thus transverse to the length of the leaching unit. See FIG. 3. FIG. 5 is a bottom view of an exemplary pillar assembly 32; it shows the extent of the spacing apart and interconnection of the pillars 30.

In a preferred embodiment of leaching unit 20 shown in FIG. 1-3, each pillar assembly 32 comprises 21 pillars. In the generality of the invention, fewer or more pillars may comprise a pillar assembly. As described below, pillar assemblies are preferably one-piece molded units. In other embodiments the pillar assemblies may be weldments or mechanically fastened assemblies or hollow units. See the discussion below.

It will be appreciated that the interconnection of the pillars by struts at mid-elevation provides significant lateral support to the pillars, increasing their resistance to buckling and enabling them to be smaller in diameter DP (or analogous dimension if the pillars are not circular in cross section) than they would otherwise have to be for comparable buckling resistance. Having interconnected pillar assemblies, whether at the mid-point or elsewhere as described below, provides the pillars with resistance to canting or tipping if the load direction on the canopy should be unaligned with the pillar vertical axis (as could happen with a unit 20 is placed on a somewhat sloped support surface).

Having interconnected pillars also facilitates manufacture of leaching units and their handling and placement thereafter. Compared to a hypothetical leaching unit which is comprised of a canopy having pillars which are only interconnected by means of the canopy (i.e., there are no connectors like struts 34) a typical leaching unit 20 of the present invention can more easily be set in place properly with the pillars assuredly vertical as desired. Within the meaning of this description and the claims, for pillars to be interconnected, there is interconnecting structure in addition to the canopy.

Figure 8:
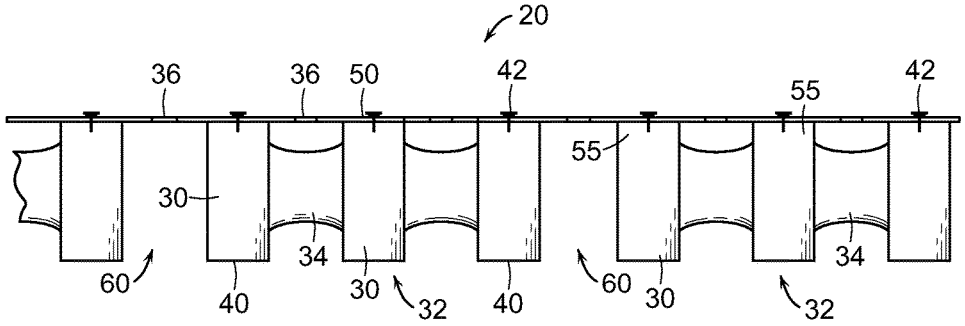
FIG. 8 is a side elevation view of a portion of one of the leaching units shown in FIG. 1
Figure 9:
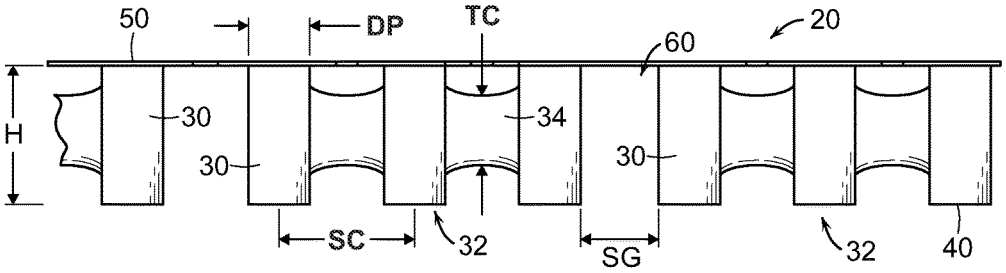
FIG. 9 is like FIG. 8, with dimensions labeled.

FIG. 8 is a side elevation view of a portion of representative leaching unit 20. FIG. 9 shows the same item as is pictured in FIG. 8, except for having many related dimensions labeled. With reference to FIG. 9, it is seen that the vertical dimension TC of the struts 34 is preferably a substantial fraction—preferably between 32 and 70 percent of the vertical height H of the pillars, to thereby provide structural strength to the pillar assembly when it is made of the preferred structural polystyrene foam, while still providing within the leaching unit a desirable open space within which can be contained wastewater, prior to percolation into the soil.

The top ends 55 of pillars 30 are attached to canopy 50, preferably by means of fasteners such as pins or staples 42 which run through the canopy into the pillar. Alternately, the pillars may be attached to the canopy by other means including adhesives, welding, etc. In the embodiments of the present invention a pillar assembly may be attached to a canopy by fastening less than all the pillars to the canopy, since each pillar is part of an assembly.

Water may be flowed into a leaching unit by running a perforated pipe along the length of the top of the unit, or by a pipe connected to a port made in the canopy, or preferably into the end or side of the unit. FIG. 2 shows an end cap 28 which facilitates connecting an inflow pipe to the end 26 of a leaching unit 20. End cap 28 has a vertical face 44 from which projects stub inlet pipe fitting 46. Upper lip 48A and lower lip 48B respectively fit the top and bottom surfaces of a pillar assembly 32. The length of lower lip 48B may extend lengthwise along the length of the unit 20 further than shown in FIG. 2, to provide a splash plate for water which enters through inlet 46. The end cap is secured to the pillar assembly by pins 52 which run through holes in one or both lips and into the pillars at the end of the leaching unit. The pins may be like pins 58 that are used to secure the joint between mated leaching units, described below; alternatively staples or other fasteners may be used.

In use, a pipe carrying wastewater is connected to the inlet. A like cap may be placed on the second end 24 of a leaching unit 20 (when the canopy at end 24 is suitably cut to have the same shape as it has at end 26); and multiples of assemblies may thus be serially interconnected by pipes when it is desired to space apart leaching units. In other uses of the leaching unit of the present invention, where water is drained from soil, water will flow into spaces amongst the pillars and pillar assemblies and will flow from a pipe connected to the leaching unit, typically by gravity.

FIG. 6 is a more detail side elevation view of the joint 22 which is formed between two interconnected leaching units, namely leaching unit 20 and leaching unit 20A s shown in FIG. 1. With reference again to FIGS. 1 to 3, the canopy 50 at end 24 of a leaching unit projects in the form of tab 56 beyond the pillar assembly which is nearest the end 24. The canopy extends further from the pillar assembly which is nearest end 24 than does the canopy extend from the pillar assembly which is nearest end 26. Tab 56 preferably has a multiplicity of holes 54. (Tab 56 also preferably has slots 53 near the holes 54; they are large enough for a person's fingers, for dragging a unit 20 during handling.). See FIG. 3. As shown in FIG. 6, tab 56 flexes upwardly a bit, enabling it to overlap the canopy 50 at end 26 of like leaching unit 20A. Several pins 58, which may have barbed or serrated shafts for holding purposes, pass through the holes/slots 54 in the canopy and into pillars 30 of leaching unit 20A. Alternatively, each pin 58 will have a head which passes through a hole 54, and the pins can be pre-installed at the factory. In the field, an installer will lap the tab of an adjacent unit on to the top of a first unit, engaging it with the heads of the pins, with a loose fit or a snap fit between the heads and the tab-holes.

It sometimes happens that trenches for leaching devices cannot be straight—the usual preference. Sometimes there are obstructions; other times the leaching trench follows the side contour of a hill; other times there is imperfect trenching. Generally, as well known, it is an aim to have a leaching unit buried in earth while lying level, or nearly level with a slight downward pitch from the water entry point. Some vertical undulation, along the length of one or a multiplicity of interconnected leaching units, may nonetheless be encountered and accommodated. The present invention has features which enable installation of leaching units in trenches which are not straight or which undulate in the vertical plane.

Figure 7A:
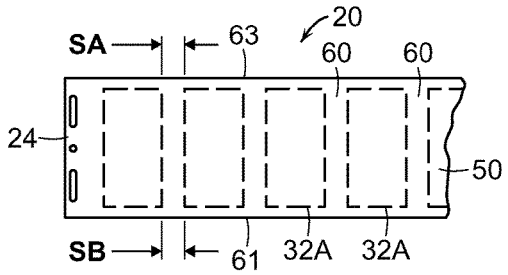
FIG. 7A is a schematic view of a portion of the top of a leaching unit which is straight.
Figure 7B:
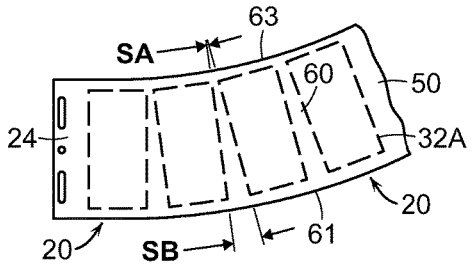
FIG. 7B is a schematic top view, showing the leaching unit of FIG. 7A in bent condition.

FIGS. 7A and 7B are schematic top views of a portion of exemplary leaching unit 20, to illustrate how the construction of a leaching unit enables bending in the lateral plane, that is, the plane of the canopy 50, which in use substantially conforms to the horizontal plane of the earth. Leaching unit 20 shown in FIG. 7A and FIG. 7B has a first lengthwise side 61 and a second lengthwise side 63. In FIG. 7A leaching unit 20 is straight; in FIG. 7B it is bent laterally. Referring first to FIG. 7A, pillar assemblies which are attached to the canopy, but which are hidden in the top view of the Figure, are schematically represented by dashed rectangles 32A. As noted previously, there are spaces 60 between the adjacent pillar assemblies 32. As shown in FIG. 7A, that spacing has a dimension SB on the first side 61 and an equal dimension SA on second side 63 when the unit 20 is straight. (Dimensions SA and SB in a straight unit are the same as dimension SG referred to in connection with FIG. 9, discussed below.)

In embodiment of the invention being presently described, the thickness and material properties of the sheet which comprises canopy 50 are selected so that preferably the sheet is (a) sufficiently strong to carry the overlying load of soil, etc., where the sheet spans the spaces between the pillars 30 within an assembly 32, and across the spaces 60 between assemblies 32; and (b) weak enough to buckle when the leaching unit 20 is bent in the horizontal plane. An exemplary canopy sheet material is thin and elastic. An exemplary material, namely about 0.12 inch thick LDPE sheet, has suitable properties. Thus as indicated by FIG. 7B, when a person pushes on a leaching unit laterally with sufficient force to bend it laterally, the dimension SA shortens as the sheet of the canopy which spans space 60 buckles, inasmuch as it is unconstrained by interconnected pillars. During bending the space SB on the opposite side of the chamber is unchanged. Since the length of side 63 is shortened and the length of side 61 remains unchanged, the leaching unit assumes a bent shape as illustrated in FIG. 7B. During the bending process, canopy 50 may be able to stretch a little and increase dimensions SB, although the amount would be minimal insofar as contributing to enablement of bending. Any canopy which was readily capable of stretching would be undesirable insofar as supporting the overlying load of soil.

Figure 10:
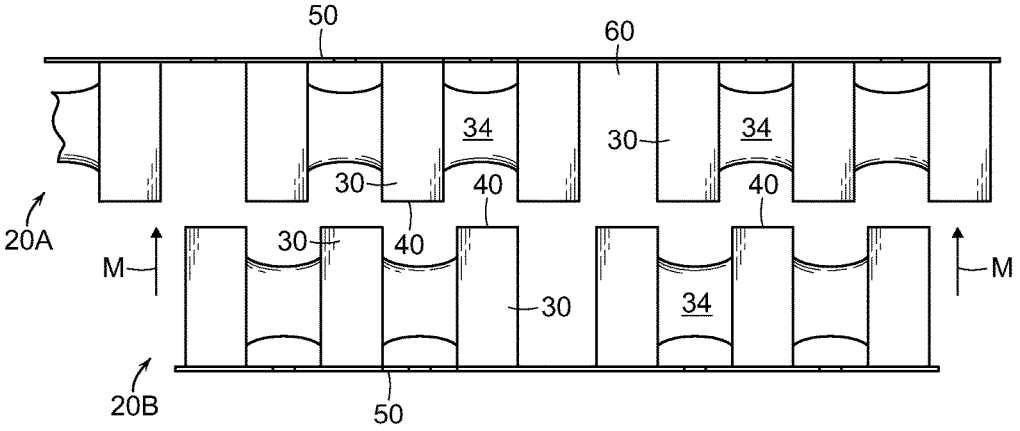
FIG. 10 is a side elevation view of two-like leaching units, showing how one leaching unit mates with a like leaching unit which is turned upside down.

FIG. 10 shows identical leaching units 20A, 20B and illustrates how the units mate for compact storage and shipment. Unit 20B is shown upside down compared to unit 20A which is shown in the normal use orientation. The units are offset relative to each other so that the pillars 30 of one unit will slip into the spaces between the pillars 30 of the other unit, when unit 20B is moved into nesting engagement with unit 20A, as indicated by arrows M. As reference to FIG. 5 will show, the alignment of the two units during this mating is not critical because the spaces amongst the pillars of preferred leaching units are large compared to the lateral dimensions of the pillars. In a preferred leaching unit 20, the aforesaid mating enables two about 8 inch high units to have a height (also called thickness) of about 11.3 inches. Compared to the height of two units which are stacked when in each is in the same orientation; two mated-for-storage units of the present invention have substantially less height, namely the mated assembly has less than about 90 percent of the height of two units, optimally about 70 percent.

FIG. 9 shows the dimensions of an exemplary leaching unit 20. Pillars 30 have a height H of 8 to 9.4 inches; and a diameter DP of 2 to 3 inches. The pillars 30 are spaced apart center-to-center 4 to 6 inches, preferably about 5.25 inches in the leaching unit width direction and about 5 inches in the leaching unit lengthwise direction. Struts 34 have lengthwise axes which are parallel to the plane of the canopy and the planes of the tops and bottoms of the pillars. The struts are centered on the vertical height of the pillar. The struts preferably have a nominal vertical thickness of about 3 to 6.6 inches, preferably 4.8 inches. Struts which are smaller than indicated may provide insufficient stability to the pillars, in resisting canting. Struts which are larger than indicated can unnecessarily comprise per unit length storage volume. As mentioned above, the vertical dimension of the struts 34 is preferably between 32 and 70 percent of the vertical height of the pillars. The adjacent pillar assemblies 32 are spaced apart a distance SG which preferably correlates with the strut-created spacing between pillars within an assembly.

A preferred embodiment leaching unit is about 34 inches wide and 120 inches long. The area of canopy 50 is about 9080 square inches and the total area of the bottoms 40 of all the pillars is about 1370 square inches; so the ratio of bearing area (foot prints of all the pillars) of the unit to the total area is about 0.15 to 1. In the context that the size and number and spacing of pillars may be varied, in other embodiments, the ratio of pillar bearing area to total area under the canopy may range from 0.06 to 1 to 0.21 to 1. If the bearing area is less than indicated, the pillars can be prone to sinking into the underlying soil; and if the bearing area is more than indicated and the pillars are solid as preferred, the per unit length capacity of the unit to store water can be insufficient for practical and regulated use.

A preferred embodiment of the kind referred to above provides at least about 8 to 12.1 gallons per linear foot of leaching unit and a leaching area of at least about 2.25 to 2.27 square feet per linear foot of leaching. Both those properties compare favorably to technologically competing products such as leaching chambers and drainage units referred to in the Background.

Figure 11:
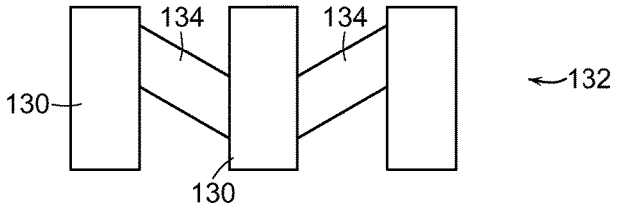
FIG. 11 is an end view of a pillar assembly having angled struts connecting the pillars.
Figure 12:
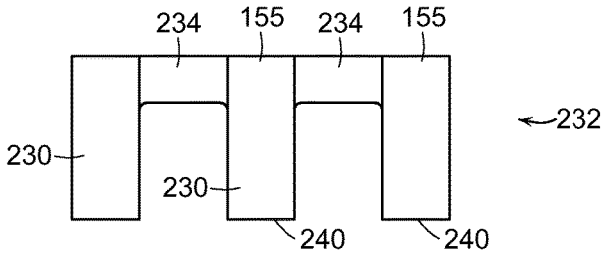
FIG. 12 is an end view of a pillar assembly having struts which connect the tops of the pillars.
Figure 13:
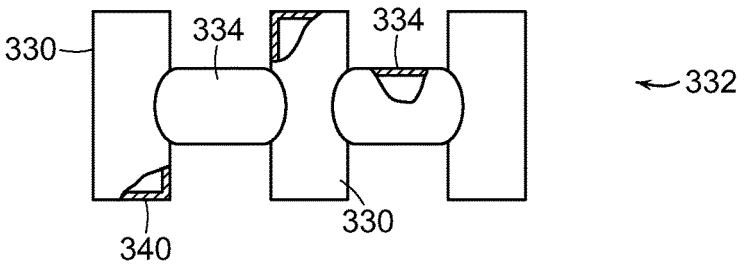
FIG. 13 is an end view of a pillar assembly comprised of hollow cylinders.

The pillars may be connected to each other in alternative ways in other embodiments of the invention. FIG. 11-13 show end view elevation views of some alternative embodiment pillar assemblies. Elements with numbers having the same last two digits as elements previously described are corresponding elements. FIG. 11 shows pillar assembly 132 having pillars 130 connected by struts 134 which are angled. FIG. 12 shows pillar assembly 232 having pillars 230 with bottoms 240; the pillars are connected by struts 234 which run laterally at the tops 155 of the pillars. In this embodiment, the canopy may be attached to the struts instead of, or in addition to, being fastened to the tops of the pillars; and such canopy attachment shall be considered equivalent to attachment to the tops of the pillars. In another embodiment, not illustrated but readily understood, the struts are located along the height of a pillar without being centered on the midpoint height.

Figure 13A:
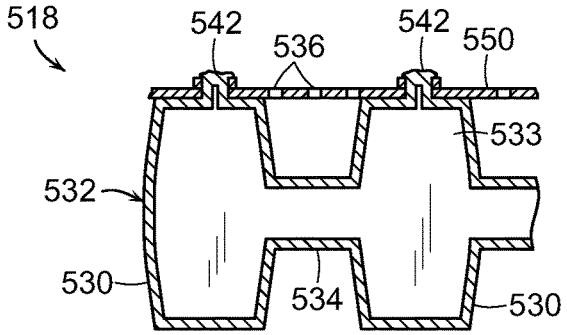
FIG. 13A is a side elevation cross section view of a leaching unit comprised of hollow pillars interconnected by hollow struts.
Figure 13B:
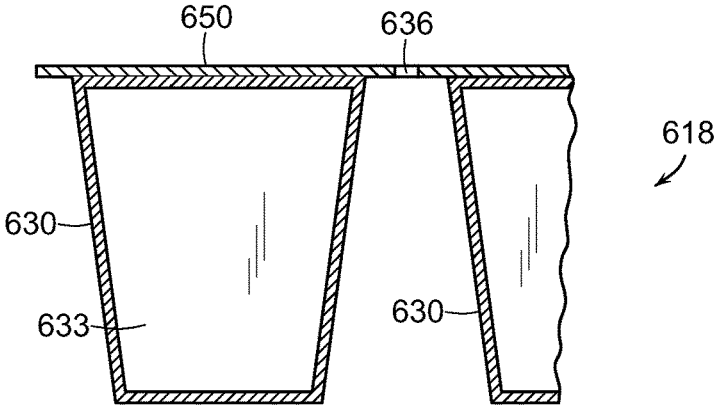
FIG. 13B is a side elevation cross section view of a leaching unit comprised of hollow pillars attached to a canopy.

FIG. 13 shows pillar assembly 332 comprised of pillars 330 which are connected by struts 334; the pillars and struts are hollow tubes, with the bottoms 340 of the struts, at least, preferably closed to provide bearing area on the underlying soil. FIG. 13 may be a weldment or a blow molded unit. FIG. 13A is a vertical cross section through a portion of leaching unit 518 comprised of pillar assemblies 532 made up of pillars 530 and struts 534, all of which are hollow and interconnected. Each pillar has a projection 542 which penetrates through a hole in the canopy 550. The canopy may be secured to the pillar by means such as a ring, clip, or by post-hole-insertion deformation of the projection. FIG. 13B is a vertical cross section through a portion of leaching unit 618 wherein canopy 650 having holes 636 is attached by adhesive or thermal bonding to the tops of tapered cone shape hollow pillars 630. Each pillar preferably has a sealed interior 633. In leaching units 518 and 618 the interior hollow spaces of the pillars may be alternatively (a) vented to the surrounding space, (b) sealed with atmospheric pressure air trapped within, or (c) sealed with pressurized air or other gas trapped within. The latter two embodiments will provide a pillar/pillar assembly with increased stiffness and load bearing capacity. The pillars may be pressurized by injecting gas through a port which is then sealed, or other known means for pressurizing sealed non-metal objects. The pressure will be up to that which causes substantial distortion of the pillar.

Figure 14:
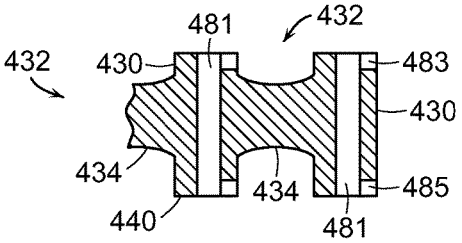
FIG. 14 is a partial transverse cross section of a pillar assembly having pillars with hollows and associated passageways.

FIG. 14 is a vertical cross section through the end of pillar assembly 432 which is comprised of pillars 430 made of cellular foam, interconnected by struts 434. The pillars have central cavities 481 for lightness and semi-circle cutouts, or ports 483, 485 at the top and bottom ends to enable water to enter and leave the central cavity, to thereby provide increased storage volume to a leaching unit, compared to a leaching unit with sealed or solid pillars. The struts of leaching unit 20 may be modified to have hollow cores.

While the pillars have been shown as having a circular cross section, in other embodiments of the invention pillars may have non-circular cross sections, including oval, rectangular, polygon, and cross shape cross sections. Similarly, pillars may have a width dimension which varies with height.

Figure 16:
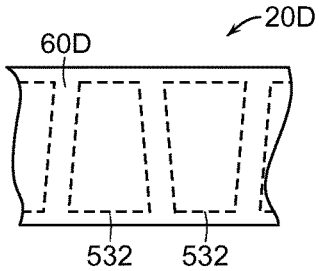
FIG. 16 is a schematic top view like FIG. 7A, showing a leaching unit comprising trapezoid shape pillar assemblies.
Figure 17:
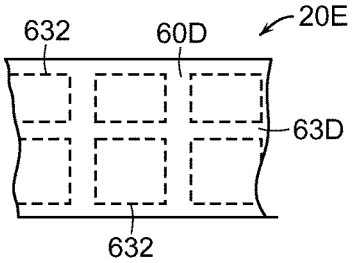
FIG. 17 is a schematic top view like FIG. 7A, showing a leaching unit comprising pillar assemblies which are spaced apart both laterally and lengthwise from each other.

Pillar assemblies may have other shapes and spacings than those which are described above. For example, as shown in FIG. 16 (which is like FIGS. 7A & 7C in showing the pillar assembly shape as a dashed line), when viewed from the top the pillar assemblies 532 of leaching unit 20D may have a trapezoid shape; in another alternative, the assemblies may have another symmetrical or non-symmetrical shape. In these embodiments; and the space between lengthwise-spaced apart pillar assemblies may be off-orthogonal to the length of the leaching unit, as is the case in leaching unit 20D. As shown in FIG. 17, pillar assemblies 632 may not run the whole width of a leaching unit: pillar assemblies 632 of leaching unit 20E have both transverse spacings 60D and lengthwise spacings 63D. Pillar assemblies may also extend to less than substantially the whole width of the canopy and leaching unit.

Figure 15:
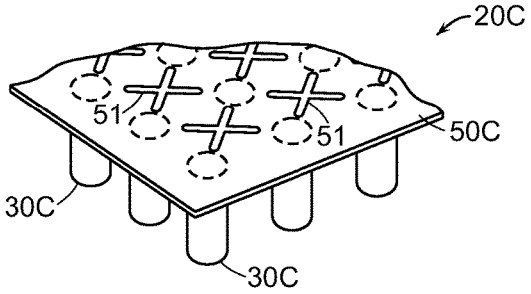
FIG. 15 is a fragmentary perspective view of the corner portion of a leaching unit having an embossed sheet canopy.

In embodiments of the present invention a canopy may have other shape perforations than described above or may be comprised of a permeable material. Further, as shown in FIG. 15, leaching unit 20C has a canopy comprising a sheet having embossing 51, for example cross-shape embossing as shown, for stiffening of the canopy where it runs between the tops of the pillars. Other embossing of the sheet may comprise dimples, corrugations and other like features known for providing stiffness to flat sheets. A leaching unit, viewed from above, may have other than the exemplary oblong rectangular shape of the Figures. For example, when looking down onto the canopy, a leaching unit may be square in shape, of another polygon shape, or it may be irregular in shape.

While the leaching units of the present may be made of different materials including such as rubber or impregnated wood products, etc., plastic is the preferred material. In particular, the canopy portions are preferably made of 0.12 inch thick low density polyethylene (LDPE), alternatively polypropylene, alternately another thermoplastic or thermoset plastic known to be functionally substitutional for LDPE from a strength and environmental degradation resistance standpoint. For example, a canopy may be made of ABS or nylon sheet. Preferably, solid pillars (also called columns)

may be made of a low density (up to about 2 pounds per cubic foot) injection molded polystyrene foam having structural properties. When the pillars are hollow they may be made of polystyrene or a polyolefin such as polyethylene or polypropylene. The geotextile fabric which is attached to or laid onto the canopy may be a commercial material such as is commonly used in connection with subsurface sewage disposal systems and drainage systems, and which is described in patents relating to leaching chambers and systems.

Figure 18:
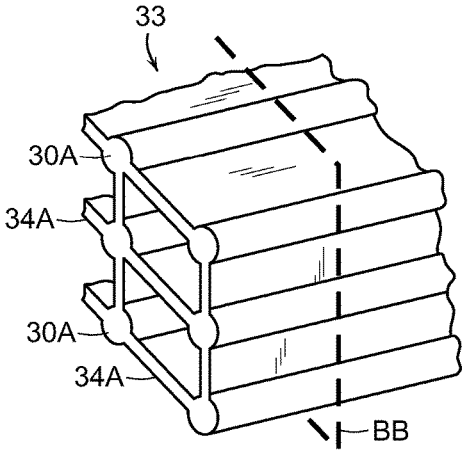
FIG. 18 is a perspective view of the end of a plastic extrusion showing how it may be cut to form one of many pillar assemblies.

The pillar assemblies may be made in alternative ways from those which have been mentioned. For example, FIG. 18 is a perspective view of a portion of a thermoplastic structure 33 is made by extrusion, and which has an "infinite" length. As indicated by the dashed line, the structure may be cut along plane BB to produce a pillar assembly comprised of pillars 30A, interconnected by struts 34A.

Implicitly described in the foregoing is a method for receiving and dispersing water, or alternatively collecting water and other liquids within soil, or other granular medium. The method involves using a leaching unit as described herein, making a substantially flat bottom trench in soil, placing the leaching unit in the soil and bending the leaching unit as needed where the pillar assemblies are spaced apart, to conform with undulations or lateral curves in the trench. In the method, the installer will optionally mate the units by lapping and securing the canopy extension of one unit with the abutting unit, as described above. In the method, the installer will optionally run a pipe to the end or onto the top of a leaching unit or multiplicity; then the installer will backfill soil onto the unit(s), and then in the method there will be either flow of (waste) water to the unit, or flowing of water from the unit, according to whether it is being used to leach such as wastewater into the soil, or to collect and drain water from the soil.

While a main object of the invention is to provide a low profile leaching unit, and a leaching unit comprised of pillars with attached canopy achieves that, leaching units of the present invention may be useful by stacking one upon the other within a trench in soil. FIG. 19 is a semi-schematic end view of four leaching units 20F stacked one upon the other to form leaching assembly 82 within a trench 70 having a bottom 72. In carrying out this embodiment, each leaching unit 20F may be optionally like one of the many which are described above. For simplicity of presentation, only the canopy 50F and pillar 30F portions of units 20F are illustrated in FIG. 19 and FIG. 20. Waste water may be flowed into one end of a leaching unit, from unshown ports in the canopy, or from a perforated pipe (not shown) laid on top of the unit in accord with what has been described herein for a one-layer-thick leaching unit. FIG. 20 shows a like leaching assembly 82A which like the assembly 82, but which has a perforated wall pipe 86 running along the length of the interior of the assembly, to distribute water within the assembly. In alternative embodiments of leaching assemblies 82, 82A, the pillars 30F in one leaching unit may be spaced differently from those of the overlying or underlying unit, the pillars of one unit may be directly above those of the overlying/underlying unit, or there may be additional pillars at the lengthwise sides of the unit (as exemplified by phantom pillars 84 in FIG. 19) for enhanced structural soundness.

The objects of the invention may thus be achieved by what is described above. It is economical to make the pillar assemblies, and leaching units, on a production basis at a relatively low cost. Assembly of the unit, that is attachment of the canopy to the pillars and optional attachment of the geotextile to the canopy, is straightforward and amenable to easy automated production. The units are low profile. The units may be shipped in compact fashion. The units compare favorably to the cylindrical bead-in-netting prior art units, such as described in U.S. Pat. No. 8,256,990, on a leaching area per truckload basis (where the number of units carried is volume-limited).

The invention, with explicit and implicit variations and advantages, has been described and illustrated with respect to several embodiments. Those embodiments should be considered illustrative and not restrictive. Any use of words which relate to the orientation of an article pictured in space are for facilitating comprehension and should not be limiting should an article be oriented differently. Any use of words such as "preferred" and variations thereof suggest a feature or combination which is desirable but which is not necessarily mandatory. Thus embodiments lacking any such preferred feature or combination may be within the scope of the claims which follow. Persons skilled in the art may make various changes in form and detail of the invention embodiments which are described, without departing from the spirit and scope of the claimed invention.

What is claimed is:

1. A leaching unit, for receiving and dispersing water and other liquids when buried within soil or other granular medium, the unit having a top, bottom, length, a first lengthwise end, an opposing second lengthwise end, a width, and a height extending from the top to the bottom, comprising:

(a) a plurality of pillar assemblies, each spaced apart from the other along the length of the leaching unit by a pillar assembly space, each pillar assembly comprised of a multiplicity of spaced apart pillars, each pillar having a length extending in the height direction of the leaching unit, an upper lengthwise end shaped for mating with a canopy made of sheet material, a lower lengthwise end shaped for soil-bearing contact, and a middle portion running between the upper end and the lower end;

a multiplicity of struts, interconnecting the pillars, each strut having a length extending laterally with respect to the length direction of a pillar, each strut having a width dimension which extends in the same direction as does the length of a pillar;

wherein each pillar is connected to another pillar within the pillar assembly by at least two of said struts;

wherein each pillar assembly space is free of struts that interconnect pillars; and, (b) a canopy, comprised of sheet material, forming the top of the drainage unit, for carrying weight of soil placed on the leaching unit during use, the canopy having a top surface and associated top surface area, and a width and length respectively corresponding with the width and length of the leaching unit, the canopy attached to said upper lengthwise ends of a multiplicity of said pillars within each pillar assembly wherein the canopy width and length substantially lie in a plane which runs transverse to the lengths of said pillars;

the canopy having a free end at each end of the leaching unit, the free end extending beyond the top of the pillar assembly nearest the respective end; wherein the amount of extension at the first end is greater than the amount of extension at the second end.

2. The leaching unit of claim 1 further comprising an end cap connected to the leaching unit at the second end thereof, the end cap comprising a wall which extends in the widthwise direction of the leaching unit; the wall having a fitting or port for connection of an inflow pipe.

3. The leaching unit of claim 1 in combination with a second like unit, the leaching units mated lengthwise end to lengthwise end, with the canopy at the first end of the first leaching unit overlapping and attached to the canopy at the second end of the second leaching unit.

4. The leaching unit of claim 3 further comprising an end cap connected to the leaching unit at the second end of the first leaching unit, the end cap comprising a wall which extends in the widthwise direction of said leaching unit, and the wall having a fitting or port for connection of an inflow pipe.

5. The leaching unit of claim 1 wherein canopy is comprised of a first sheet having a first plurality of openings and a second sheet having a second plurality of openings;

wherein the first sheet is attached to a plurality of tops of the pillars of each pillar assembly and the second sheet lies on top of the first sheet, optionally fastened thereto; wherein the first sheet and second sheet each have a plurality of openings configured for passage of water and gas; and, wherein the openings in the second sheet are substantially smaller than the openings in the first sheet, to inhibit passage of particulates from soil overlying the canopy during use through openings of the first sheet.

6. The leaching unit of claim 1 wherein each pillar of said multiplicity is integral with said at least two struts.

7. The leaching unit of claim 1 wherein each pillar of said multiplicity has an interior hollow which is connected to the exterior of the pillar by one or more openings.

8. The leaching unit of claim 1 wherein each pillar of said multiplicity has an interior hollow, the hollow sealed to contain air or other gas at atmospheric or higher pressure.

9. The leaching unit of claim 1 wherein the struts of the pillar assemblies are selected from the group which comprises (a) struts connecting to each pillar at the middle portion of the pillar and having strut lengths which run parallel to the plane of the canopy; (b) struts connecting to each pillar at the upper end of the pillar and having strut lengths which run parallel to the plane of the canopy, and (c) struts having lengths which run diagonally relative to the pillar lengths.

10. The leaching unit of claim 1 wherein each strut of said at least two struts has a width dimension which is between 32 and 70 percent of the vertical height of the pillar to which the strut is connected, and wherein when in contact with soil the bottom ends of all the pillars of the leaching unit provide a total soil-bearing area which is between 6 to 21 percent of the area of the canopy.

11. The leaching unit of claim 1 having a storage volume of at least about 8 gallons per linear foot of leaching unit and a leaching area of at least about 2.25 square feet per linear foot of leaching unit.

12. The leaching unit of claim 1 wherein the leaching unit is bendable in the width-wise direction, transverse to the leaching unit length, at each location where there is a pillar assembly space.

13. A leaching unit assembly comprised of a multiplicity of leaching units in accord with claim 1, stacked one upon the other.

14. A method for receiving and dispersing or collecting water and other liquids within soil or other granular medium, which comprises (a) providing a multiplicity of leaching units in accord with claim 1;

(b) forming a trench in soil of the earth, the trench having a length and a generally flat bottom lying in a substantially horizontal plane of the earth;

(c) placing each leaching unit in the trench so the leaching unit rests on said generally flat bottom of the trench, so the leaching units are mated end to end, and so each leaching unit is in water flow communication with an adjacent leaching unit, wherein the canopy at the first end of each leaching unit overlaps and attaches to the canopy at the second end of a leaching unit at locations where two leaching units abut each other lengthwise;

(d) placing a water flow pipe at the end of at least one leaching unit or across at least a portion of the canopy of one or more leaching units, for conveying water to or from the multiplicity of leaching units;

(d) placing soil on top of the leaching units to fill the trench; and, (e) either (i) flowing water from a water source through the water flow pipe so the water runs into said spaces amongst the pillar assemblies and struts, to then percolate into said soil or other granular medium, or (ii) draining through the water flow pipe water within the soil that percolates into spaces amongst the pillars and pillar assemblies.

15. The method of claim 14 which further comprises: stacking within the trench at least some of the multiplicity of leaching units one upon the other in step (c).

16. A leaching unit, for receiving and dispersing water and other liquids when buried within soil or other granular medium, the unit having a top, bottom, length, a first lengthwise end, an opposing second lengthwise end, a width, and a height extending from the top to the bottom, comprising:

(a) a plurality of pillar assemblies, each spaced apart from the other along the length of the leaching unit by a pillar assembly space, each pillar assembly comprised of a multiplicity of spaced apart pillars, each pillar having a length extending in the height direction of the leaching unit, an upper lengthwise end shaped for mating with a canopy made of sheet material, a lower lengthwise end shaped for soil-bearing contact, and a middle portion running between the upper end and the lower end;

a multiplicity of struts, interconnecting the pillars, each strut having a length extending laterally with respect to the length direction of a pillar, each strut having a width dimension which extends in the same direction as does the length of a pillar;

wherein each pillar is connected to another pillar within the pillar assembly by at least two of said struts;

wherein each pillar assembly space is free of struts that interconnect pillars; and, (b) a canopy, comprised of sheet material, forming the top of the drainage unit, for carrying weight of soil placed on top of the leaching unit during use, the canopy having a top surface and associated top surface area, and a width and length respectively corresponding with the width and length of the leaching unit, the canopy attached to said upper lengthwise ends of a multiplicity of said pillars within each pillar assembly and substantially lying in a plane which runs transverse to the lengths of said pillars; the canopy having at each end of the leaching unit a free end of the canopy that extends lengthwise beyond the pillars nearest the free end;

wherein the first sheet is attached to a plurality of tops of the pillars of each pillar assembly and the second sheet lies on top of the first sheet, optionally fastened thereto;

wherein the first sheet and second sheet each have a plurality of openings configured for passage of water and gas; and, wherein the openings in the second sheet are substantially smaller than the openings in the first sheet, to inhibit passage of particulates from soil overlying the canopy during use through openings of the first sheet.

17. The leaching unit of claim 16 wherein the canopy extends lengthwise at each end of the leaching unit beyond the top of the pillar assembly nearest the respective end; wherein the amount of extension at the first end of the unit is greater than the amount of extension at the second end of the unit.

18. The method of claim 14 wherein the trench formed in step (b) is curved in the trench lengthwise direction and wherein step (c) further comprises: bending at least one leaching unit in the horizontal plane at the location of one or more said pillar assembly spaces, sufficient to cause the canopy to buckle.

19. The method of claim 14 further comprising, prior to step (d): placing at least one end cap on the second end of at least one leaching unit where said second end is not abutted by another leaching unit; and carrying out step (d) by connecting said water flow pipe to the end cap.

* * * * *